US005109654A

United States Patent [19]

Suga

[11] Patent Number: 5,109,654

[45] Date of Patent: May 5, 1992

[54] GAS FEED ARRANGEMENT FOR SUPPLY OF GAS INTO BAGS IN A PACKAGING MACHINE

[75] Inventor: Tadoru Suga, Ibaraki, Japan

[73] Assignee: Ibaraki Precision Machinery Co., Ltd., Japan

[21] Appl. No.: 780,449

[22] Filed: Oct. 22, 1991

Related U.S. Application Data

[63] Continuation-in-part of Ser. No. 585,596, Sep. 20, 1990, abandoned.

[30] Foreign Application Priority Data

Oct. 9, 1989 [JP] Japan ..... 1-263574

[51] Int. Cl.[5] ..... B65B 31/04

[52] U.S. Cl. ..... 53/511; 53/550; 141/66

[58] Field of Search ..... 53/433, 434, 511, 512, 53/550, 551, 552, 553; 141/59, 64, 66

[56] References Cited

U.S. PATENT DOCUMENTS

| | | | |
|---|---|---|---|
| 1,406,380 | 2/1922 | Heath et al. | 141/66 X |
| 2,145,941 | 2/1939 | Maxfield | 53/511 X |
| 2,438,089 | 3/1948 | Carson | 53/410 |
| 3,245,200 | 4/1966 | Shaw | 53/512 |
| 3,482,373 | 12/1969 | Morris | 53/511 |
| 3,579,945 | 5/1971 | Buchner et al. | 53/511 |
| 4,642,969 | 2/1987 | Johnson | 53/511 X |
| 4,750,534 | 6/1988 | Hirasawa et al. | 141/59 X |

FOREIGN PATENT DOCUMENTS

| | | |
|---|---|---|
| 46-16638 | 6/1971 | Japan . |
| 58-90017 | 5/1983 | Japan . |

*Primary Examiner*—Robert L. Spruill
*Assistant Examiner*—Daniel B. Moon
*Attorney, Agent, or Firm*—Barnes, Kisselle, Raisch, Choate, Whittemore & Hulbert

[57] ABSTRACT

A gas feed arrangement for supplying gas into bags in a packaging machine is disclosed. A belt-like film is tubulated by a tube former and, as articles to be packaged are supplied into the tubulated film, both the tubulated film and the articles are transported while being held between a pair of tension conveyors. Double pipes, each consisting of an outer evacuation pipe and an inner gas jet pipe, are inserted into the tubulated film. The locations for evacuation and gas blow by the inner and outer pipes within the film are spaced from each other a distance corresponding to a length of more than one article. Cushion blocks provided in multiplicities on a pair of tension belts exert pressure against the film from opposite sides thereby to eliminate any superfluous space within the film and, at same time, to isolate adjacent articles from each other. Thus, the oxygen present in each bag is efficiently displaced by inert gas fed into the bag, and the required inert gas consumption can be minimized.

6 Claims, 3 Drawing Sheets

GAS FEED ARRANGEMENT FOR SUPPLY OF GAS INTO BAGS IN A PACKAGING MACHINE

This is a continuation-in-part of copending application Ser. No. 07/585,596 filed on Sept. 20, 1990 now abandoned.

FIELD OF THE INVENTION

This invention relates to a gas feed arrangement for supplying gas into bags in a packaging machine and, more particularly, to an arrangement for use in a packaging machine of the type in which a belt-like film is rounded into a tube form for being formed successively into packaging bags as it is transported in a longitudinal direction, with each bag being filled with an article, for supplying inert gas into each bag simultaneously with the formation of the bag and hermetically sealing the bag with the article contained therein together with the inert gas.

BACKGROUND OF THE INVENTION

An arrangement for hermetically packing articles together with inert gas into bags has been well known which is of the type such that the periphery of each bag containing the article being packaged is airtightly enveloped in a pressure vessel, the air in the pressure vessel being expelled by suction by means of a vacuum pump, whereafter inert gas is injected into the pressure vessel, the opening of the bag being then sealed so that the article is hermetically kept in the bag.

While this known arrangement provides an advantage that a very high rate of bag displacement with gas can be achieved, it takes time to expel air from the pressure vessel, which fact is rather inconvenient from the standpoint of efficiency.

In an attempt to overcome this drawback, there has been proposed an arrangement in which a belt-like film, while being continuously transported in a longitudinal direction, is rounded by means of a tube former into a tube form and then hot welded at side edges thereof to be formed into a tube, and in which articles are filled into the tubulated film in equispaced relation and simultaneously inert gas is forcibly introduced into the film so that the air within the film is driven out under the feed pressure for the inert gas feed, the tubulated film being subsequently sealed between adjacent articles being packaged and at predetermined intervals (as disclosed in Japanese Utility Model Publication No. 46-16638 and Japanese Patent Application Laid-Open Publication No. 58-90017).

This known arrangement, wherein the air within the film is driven out under gas pressure while the film is progressively transported forward, provides greater operating efficiency as compared with the earlier mentioned arrangement using a pressure vessel. However, it is disadvantageous in that some oxygen residue is inevitable and in that greater inert gas consumption is required.

DISCLOSURE OF THE INVENTION

Accordingly, the primary object of the invention is to eliminate the above mentioned drawbacks with the prior art.

In order to accomplish this object, according to the invention there is provided a gas feed arrangement for supplying gas into bags in a packaging machine wherein the packaging machine is of the type having inlet and outlet ports for a belt-like film transported in a longitudinal direction, a tube former for deforming the film into a tube form, means for welding opposite side edges of the film as the film is deformed by the tube former into tube form, conveyor means for feeding individual articles in a predetermined cycle into an elongated tube of film so as to allow a space to be left between every two adjacent articles, and seal means disposed downstream of the tension belts for sealing the tubulated film in a direction crossing the direction of film transport to form the film into bags, the improvement comprising:

upper and lower endless belts longitudinally aligned with and disposed between said tube former and said seal means with the entubed articles adapted to be disposed between said upper and lower endless belts;

said upper and lower endless belts including a plurality of outwardly disposed cushion blocks such that a plurality of entubed articles are adapted to be held between said cushion blocks carried by said upper endless belt and said cushion blocks carried by said lower endless belt, said cushion blocks having a thickness such that said elongated tube of film is adapted to be pressed flat by said cushion blocks in said space between two adjacent articles;

double pipe means received into said tube former through the entry port thereof and including an outer evacuation pipe and an inner gas jet pipe, the evacuation pipe having an area provided with a plurality of suction holes;

means for connecting, at the entry port of said tube former, one end of said gas jet pipe to a gas supply source through a gas line and one end of said evacuation pipe to a vacuum source through a vacuum line;

said gas jet pipe having another end such that the distance between said another end of said gas jet pipe and said area of said evacuation pipe provided with said suction holes is longer than a distance between the leading edges of two adjacent articles; and said area of said evacuation pipe provided with said suction holes being disposed between said cushion blocks carried by said upper endless belt and said cushion blocks carried by said lower endless belt.

According to such arrangement, the belt-like film is rounded by the tube former serially into a tube form and its opposite edges are welded together so that the film is formed into a tube. The feed conveyor supplies articles at uniform intervals into the tubulated film through the entry port of the tube former, and entubement of the spaced articles in an elongated tube of the film is thus effected.

The cushion blocks carried by the upper and lower endless belts have a thickness such that these cushion blocks not only cling to nearly the entire surface of each of the film enveloped articles but also are pressed against each other in the area between the adjacent entubed articles so that the spaces surrounding the individual articles within the elongated tube of the film may be pneumatically isolated from each other, so that the air within the film is caused to cease circulation. Thus, as individual cushion blocks of the tension belts pass the vicinity of the evacuation pipe, the air present between the cushion blocks is pressed and driven out by the cushion blocks so that the air is successively sucked into the evacuation pipe. Inert gas is blown into the film out of the gas jet pipe at a downstream location. Subsequently, individual pieces of articles, together with inert gas, are sealed hermetically in bags by the seal means.

Therefore, the gas feed arrangement of the invention permits higher oxygen displacement with inert gas and requires less inert gas consumption as compared with the known arrangement using gas pressure for driving the air out.

DESCRIPTION OF THE PREFERRED EMBODIMENT

Figure 1:
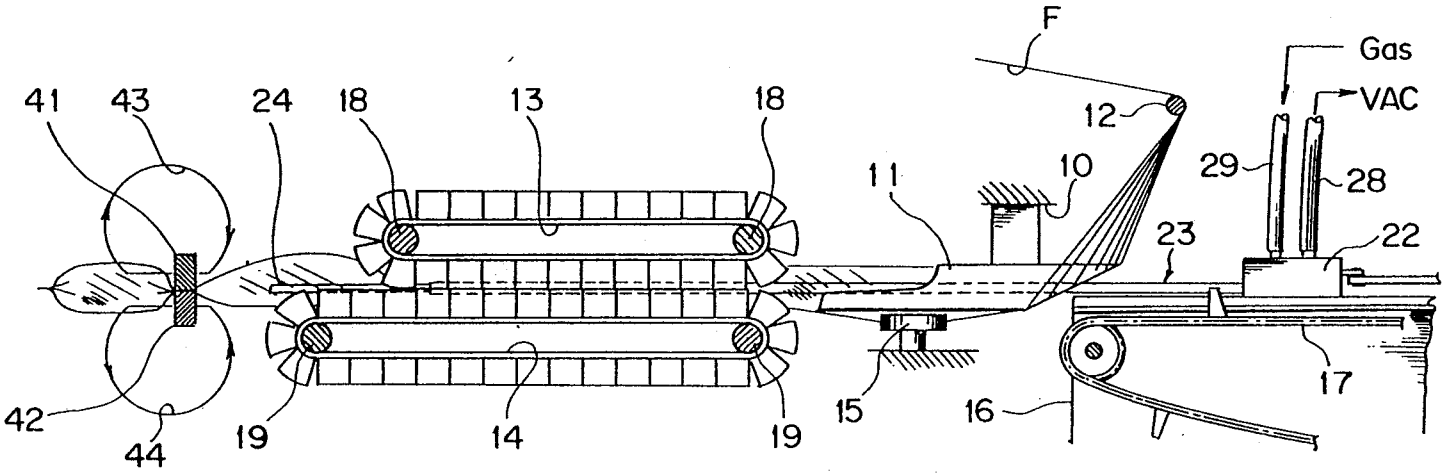
FIG. 1 is a side view of an arrangement representing one embodiment of the invention.
Figure 2:
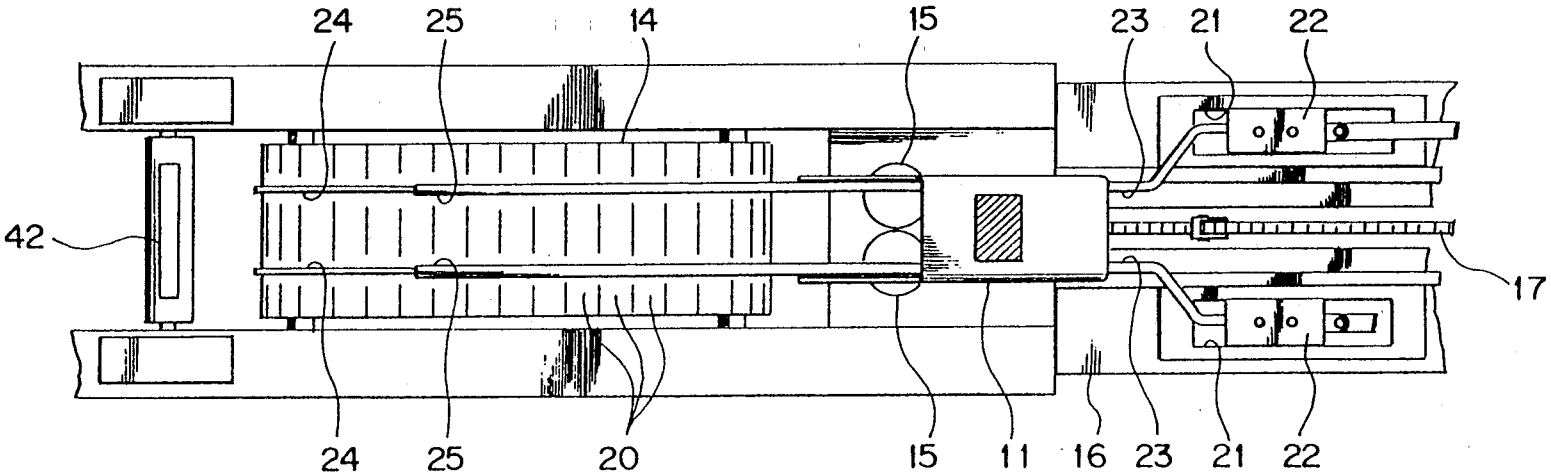
FIG. 2 is a plan view of the arrangement with the upper tension belt removed therefrom.
Figure 3:
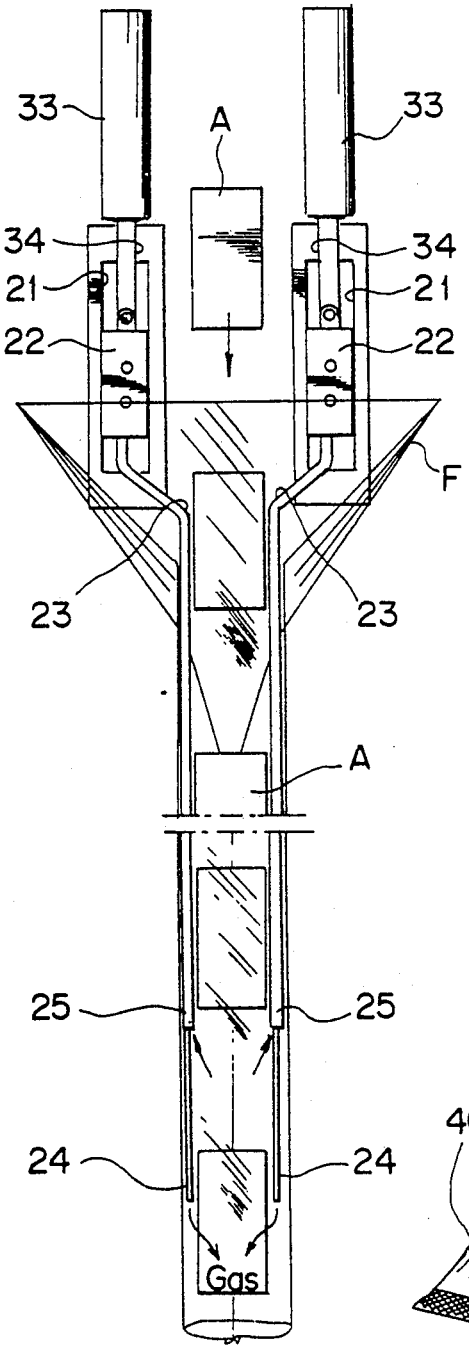
FIG. 3 is a plan view showing the condition of inert gas being introduced into the film.

In FIG. 1, a tube former 11 supported on a machine frame 10 has a rectangular cylinder-shaped sectional configuration. A belt-like plastic film (F) is guided to the tube former 11 via a tension roll 12. A roll mechanism (not shown) which positively delivers film (F) at a predetermined rate is disposed upstream of the tension roll 12. Film (F) is transported by means of the roll mechanism and a pair of tension belts 13, 14 disposed downstream of the tube former 11 while it is serially rounded into a tube form. As the film (F) is so transported, a pair of center seal rollers 15, 15 disposed below the tube former 11 as shown in FIG. 2 operate to put the side edges of the film (F) together, one over the other, and hot-weld them to ensure more accurate tubulation of the film (F). A chain-type feed conveyor 17 supported by a frame 16 located adjacent an entry port of the tube former 11 feeds a multiplicity of articles (A), (A) . . . at uniform intervals into the tubulated film (F) as shown in FIG. 3.

Figure 6:
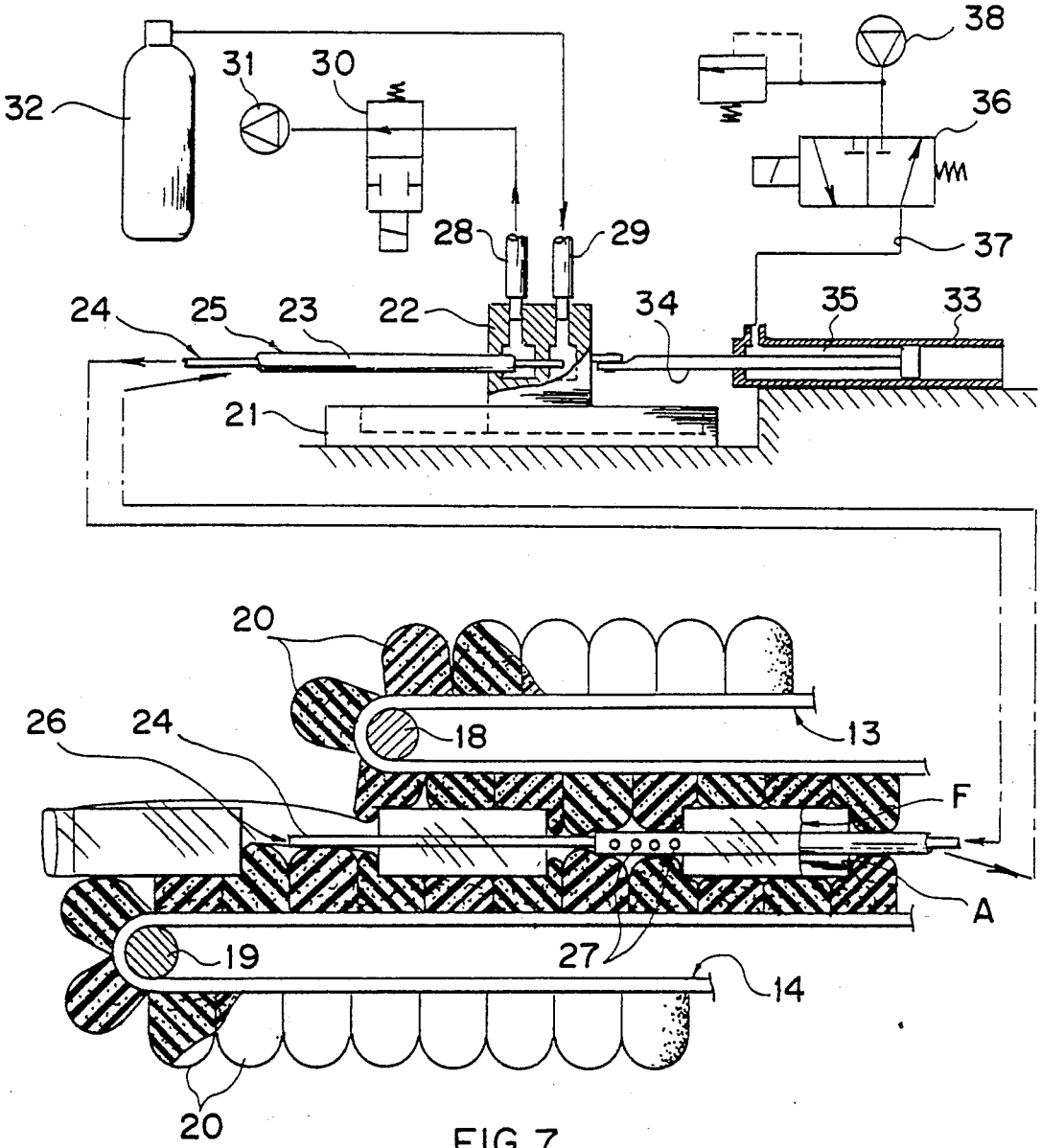
FIG. 6 is a view showing the condition of gas being supplied into a space around each article as transported while being held between the belts, the space being depressurized.

In FIG. 1, the tension belts 13, 14 are carried by a plurality of pulleys 18, 18, 19, 19. On the peripheries of the upper and lower belts 13, 14 are arranged cushion blocks 20, 20 . . . in multiplicities as illustrated in FIG. 6, each cushion block 20 being comprised of a soft rubber foam enclosed with a cloth-made sack. Accordingly, individual cushion blocks 20 serve to hold each article (A) from opposite sides, upper and lower, and at same time to flatten the tubulated film (F) between adjacent articles (A) as the film (F) is transported.

As FIG. 2 shows, a pair of guides 21, 21 are disposed on the top side of the frame 16 of the feed conveyor, and double pipes 23, 23 are respectively connected at one end to slide blocks 22, 22 slidably mounted on the respective guides, the pipes being positioned on the belt 14 after passing through the interior of the tube former 11 at opposite sides thereof. As shown in FIG. 6, each double pipe 23 comprises an inner gas jet pipe 24 and an outer evacuation pipe 25. A gas jet hole 26 is shown in position at the foremost end of the gas jet pipe 24 for introduction of inert gas just prior to closure of the wrapping tube by means of the seal means to form a package. The evacuation pipe 25 has an area provided with a plurality of suction holes 27. The distance between the foremost end of the gas jet pipe 24 and the area of the evacuation pipe 25 provided with the suction holes 27 is longer than a distance between the leading edges of two adjacent articles (A). A vacuum line 28 connected to the top of each slide block 22 is in communication with one evacuation pipe 25 in the interior of the slide block, while a gas line 29 is in communication with one gas jet pipe 24. The end of the vacuum line 28 is connected to a vacuum pump 31 via an electromagnetic on-off valve 30, and the end of the gas line 29 is connected to a steel gas cylinder 32. Therefore, the air present in each small space within the tubulated film (F) flattened by cushion blocks 20, 20, upper and lower, passing adjacent the suction holes 27 of the evacuation pipes 25 is sequentially sucked into the evacuation pipes 25 for being evacuated. At a more downstream location, inert gas is supplied into the tubulated film (F) through the gas jet pipes 24.

As illustrated in FIG. 6, the front side of each slide block 22 is connected to a piston rod 34 of an air cylinder 33 fixed to the machine frame. A piston rod-side chamber 35 within the air cylinder 33 is connected to an air pump 38 via a line 37 provided with a 2-position, 3-port type electromagnetic change-over valve 36. When the electromagnetic change-over valve 36 is kept at the position shown, the chamber 35 is opened to the atmosphere via the line 37. Accordingly, the double pipes 23 held between series of cushion blocks 20, 20, upper and lower, are pulled for movement in same direction as individual articles (A) in integral relation with the respective slide blocks 22 and piston rods 34 as the tension belts 13, 14 travel along.

Figure 4:
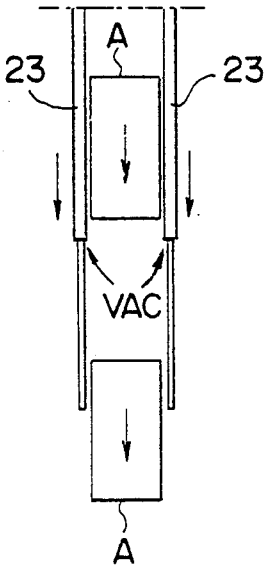
FIGS. 4 and 5 are views showing the relationship between the double pipe and articles being packaged.
Figure 5:
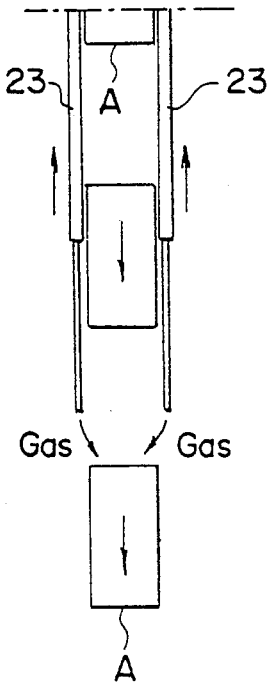
Figure 8:
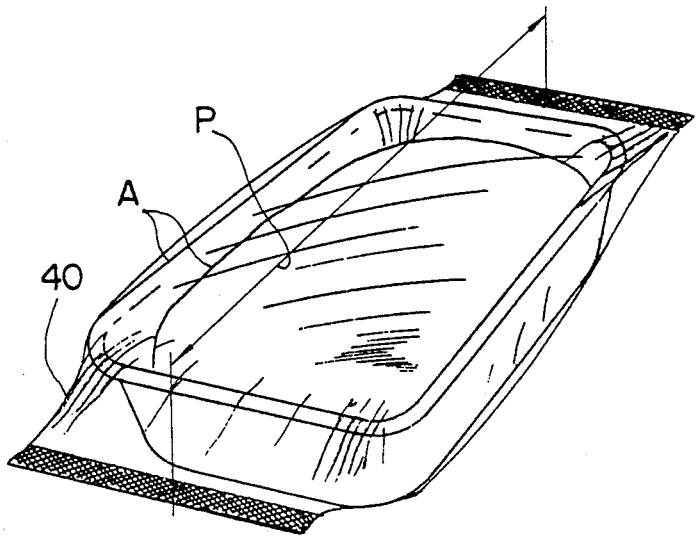
FIG. 8 is a perspective view showing a packaged article.

When the electromagnetic change-over valve 35 is switched over so as to supply compressed air produced by the air pump 38 into the chamber 35, the double pipes 23 will retreat in a direction counter to the direction of movement of articles (A). In this case, one stroke of the double pipes 23 covers a length corresponding to one half of the cut pitch (P) of bags 40 as shown in FIG. 8. That is, after articles (A) and the double pipes 23 have moved a distance equal to one half of the cut pitch (0.5 P) in same direction, as shown in FIG. 4, the double pipes 23 retreat by one half of the cut pitch (0.5 P), as shown in FIG. 5, while the articles (A) continue to advance by one half of the cut pitch (0.5 P). After all, therefore, each article (A) moves one pitch (P) for each double stroke of the double pipes 23.

When the vacuum line 28 is turned off by manipulating the electromagnetic on-off valve 30 while the double pipes 23 is being retreated, the pressing force of the cushion blocks 20, 20 against the double pipes 23 is relaxed. This permits smooth backward movement of the double pipes 23.

Figure 7:
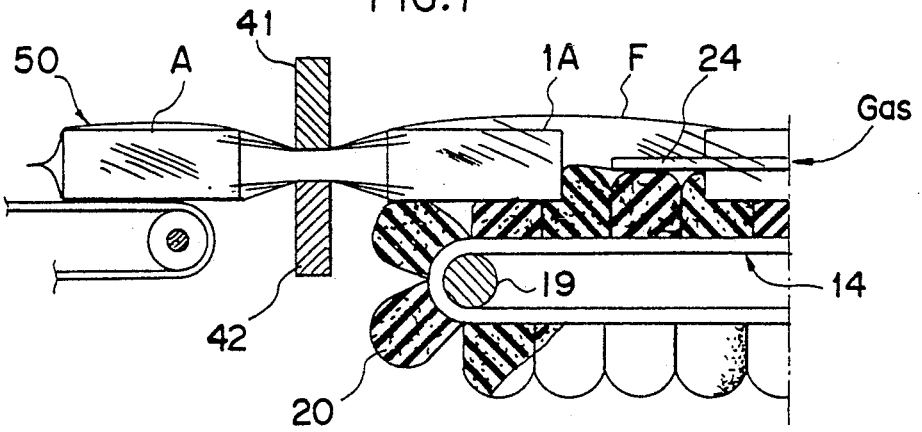
FIG. 7 is an enlarged side view showing sealers and adjacent elements.

In FIGS. 1 and 2, cross sealers 41, 42 disposed behind the gas jet pipe 24 rotate along respective oblong tracks 43, 44 as shown by arrows. The film (F) is pressed down, and welded at side edges thereof, by the upper and lower sealers and between adjacent articles (A) as FIG. 7 illustrates, whereby the articles (A) and inert gas are hermetically sealed together in bags 50.

What is claimed is:

1. A gas feed arrangement for supplying gas into bags in a packaging machine wherein the packaging machine is of the type having inlet and outlet ports for a belt-like film transported in a longitudinal direction, a tube former for deforming the film into a tube form, means for welding opposite side edges of the film as the film is deformed by the tube former into tube form, conveyor means for feeding individual articles in a predetermined cycle into an elongated tube of film so as to allow a space to be left between every two adjacent articles, and seal means disposed downstream of the tension belts for sealing the tubulated film in a direction crossing the direction of film transport to form the film into bags, the improvement comprising:

upper and lower endless belts longitudinally aligned with and disposed between said tube former and said seal means with the entubed articles adapted to be disposed between said upper and lower endless belts;

said upper and lower endless belts including a plurality of outwardly disposed cushion blocks such that a plurality of entubed articles are adapted to be held between said cushion blocks carried by said upper endless belt and said cushion blocks carried by said lower endless belt, said cushion blocks having a thickness such that said elongated tube of film is adapted to be pressed flat by said cushion blocks in said space between two adjacent articles;

double pipe means received into said tube former through the entry port thereof and including an outer evacuation pipe and an inner gas jet pipe, said evacuation pipe having an area provided with a plurality of suction holes;

means for connecting, at the entry port of said tube former, one end of said gas jet pipe to a gas supply source through a gas line and one end of said evacuation pipe to a vacuum source through a vacuum line;

said gas jet pipe having another end;

means to mount said double pipe means such that the distance between said another end of said gas jet pipe and said area of said evacuation pipe provided with said suction holes is longer than a distance between the leading edges of two adjacent articles; and said area of said evacuation pipe provided with said suction holes being disposed between said cushion blocks carried by said upper endless belt and said cushion blocks carried by said lower endless belt.

2. A gas feed arrangement for supplying gas into bags in a packaging machine as set for in claim 1, further comprising:

guide means disposed at opposite sides of said conveyor means and oriented toward the tube former;

slide block means slidable along said guide means for supporting said double pipe means; and drive means connected to said slide block means and operative in conjunction with said slide block means to reciprocally move said double pipe means in a cycle equal to the cycle in which articles are fed into said tubulated film by said conveyor means.

3. A gas feed arrangement for supplying gas into bags in a packaging machine as set forth in claim 2, further comprising means for controlling said drive means so as to cause said double pipe means to reciprocate by a stroke equivalent to half the distance of travel covered by said tubulated film during the time interval corresponding to said cycle in which articles are fed into said tubulated film by said conveyor means.

4. A gas feed arrangement for supplying gas into bags in a packaging machine as set forth in claim 2, wherein both the slide block means and the double pipe means are moved in the same direction as each article being transported by the double pipe means being held between and pulled by the tension belts and are moved counter to the direction of transport of the article by being forcibly driven by the drive means.

5. A gas feed arrangement for supplying gas into bags in a packaging machine as set forth in claim 4, wherein said drive means is a cylinder, said cylinder being such that it is released when both the slide block means and the double pipe means are to be moved in the same direction as the article and such that it is connected to a working fluid source when both the slide block means and the double pipe means are to be moved counter to the direction of transport of the article.

6. A gas feed arrangement for supplying gas into bags in a packaging machine as set forth in claim 4, wherein the gas feed arrangement includes means for disconnecting the evacuation pipe from the vacuum source when both the slide block means and the double pipe means are moved counter to the direction of transport of the article.

* * * * *